United States Patent [19]

Haller

[11] 4,120,015

[45] Oct. 10, 1978

[54] ELECTROSTATIC COATING-DISPENSING APPARATUS

[75] Inventor: Jack R. Haller, Columbus, Ohio

[73] Assignee: J. R. Haller, Ltd. Inc., Columbus, Ohio

[21] Appl. No.: 772,846

[22] Filed: Feb. 28, 1977

[51] Int. Cl.[2] ..... B05B 5/02

[52] U.S. Cl. ..... 361/227; 118/629; 239/15; 250/326; 361/230; 361/235

[58] Field of Search ..... 361/227, 226, 229, 230, 361/233, 235; 239/15; 118/621, 626, 629; 427/13, 26, 27; 250/324, 325, 326; 204/164, 192

[56] References Cited

U.S. PATENT DOCUMENTS

| | | | |
|---|---|---|---|
| 2,173,741 | 9/1939 | Wise et al. | 361/233 X |
| 3,496,911 | 2/1970 | Chmelar | 239/15 X |
| 3,740,612 | 6/1973 | Gauthier et al. | 361/227 |

FOREIGN PATENT DOCUMENTS

| | | | |
|---|---|---|---|
| 1,387,632 | 3/1975 | United Kingdom | 361/227 |

*Primary Examiner*—J D Miller
*Assistant Examiner*—Patrick R. Salce
*Attorney, Agent, or Firm*—Oltsch, Knoblock & Hall

[57] ABSTRACT

An electrostatic hand-held coating-dispensing apparatus includes a first pulley, a second pulley, and a continuous belt trained about the first and second pulleys. The first and second pulleys are supported and retained in spaced apart relation to maintain tension on the belt in a supporting housing. A first brush is provided adjacent the belt where the belt is trained about the first pulley. A second brush is provided adjacent the belt where the belt is trained about the second pulley. A curved conducting surface is also supported by the housing. The second brush is connected to the conducting surface. A small alternating current electric motor is provided for turning the first pulley. A container or canister is provided for the coating material. The canister is snugly received in the supporting housing in a position adjacent the conducting surface. The canister includes an end for transferring electrostatic potential from the curved surface to the coating material therein.

13 Claims, 5 Drawing Figures

ELECTROSTATIC COATING-DISPENSING APPARATUS

This invention relates to electrostatic apparatus for dispensing dry coating material, e.g., coating powder and flocking fiber. More particularly, the instant invention relates to an electrostatic, hand-held dispensing apparatus and to a coating material container for use therewith.

Several types of apparatus for dispensing particles of non-liquid coating material are known to the prior art.

Such types of apparatus establish a relatively high potential difference between an electrode and a target to be coated. The particles of coating material are then charged from the electrode and are allowed to move through the potential field and strike the target. Typically, in the case of flocking, the target is coated with an electrically conductive adhesive material. Such material causes the flock fibers to stick to the target and remove their charge. The following United States patents are illustrative of apparatus which functions in this manner.

| U.S. Pat. No. | Inventor | Issue Date |
|---|---|---|
| 3,691,991 | Luderer et al | September 19, 1972 |
| 3,551,178 | A Chmelar | December 29, 1970 |
| 3,496,911 | A Chmelar | February 24, 1970 |
| 2,777,977 | J. Everard | January 16, 1957 |
| 2,706,963 | R. Hug | April 26, 1955 |

Additionally, the following British patent is also illustrative of apparatus which functions in this manner: No. 1,387,632, J. Mitchell et al., Mar. 19, 1975.

Typically, such apparatus requires a relatively large, bulky and generally expensive power supply. While such devices may be suitable for large-scale operations which apply, for example, flocking material on assembly lines, they are not suitable for the hobbyist or other individual who wants to apply flock fibers to articles on a small scale, for repair work, etc.

Accordingly, it is an object of the present invention to provide a hand-held apparatus for dispensing dry coating materials. The inventive apparatus is inexpensive, compact and lightweight, and has a self-contained electrostatic high potential generator. The apparatus requires no external safety equipment. The apparatus can operate from ordinary household alternating current or from batteries.

According to the present invention, an electrostatic hand-held coating-dispensing apparatus includes a first pulley, a second pulley, and a continuous belt trained about the first and second pulleys. Means are provided for supporting the first and second pulleys in spaced apart relation. First and second means are provided for conducting electricity, the first conducting means lying adjacent the belt where the belt is trained about the first pulley. The second conducting means lies adjacent the belt where the belt is trained about the second pulley. The apparatus further includes a conductive surface for storing electrostatic potential. The second conducting means is coupled to the conducting surface. The support means further includes means for supporting the conducting surface adjacent the second pulley. Means are provided for turning the first pulley. Additional means are provided for holding the coating material adjacent the conducting surface and for transferring electrostatic potential from the conducting surface to the particles of coating material.

Further, according to the present invention, the support means comprises a housing having a generally pistol shape with a central portion housing the runs of the belt, a proximal end portion housing the first pulley and the turning means, and a distal end portion housing and supporting the second pulley and the conducting surface. In one embodiment the housing is an injection molded plastic housing. Desirably, the apparatus further includes a trigger controlled switch for actuating the turning means, the proximal end portion having a pistol grip and including a switch housing.

In an illustrative embodiment of the invention, the distal end portion of the housing extends substantially beyond the conducting surface to provide a socket between the conducting surface and the distal end of the housing. The means for holding the coating material comprises a container or canister having a side wall and first and second ends. The side wall is adapted to be snugly received in the socket. The first end comprises a material which is sufficiently conductive to conduct a charge from the conducting surface to the particles of coating material within the canister. The second end comprises a mesh for allowing charged particles of coating material to exit from the canister therethrough. In one embodiment the conducting surface has a convex generally spherical curvature and the canister first end includes a portion having a conforming concave, generally spherical curvature.

Additionally, in accordance with the present invention, the canister comprises means for dividing the interior thereof into a plurality of sections which extend substantially from the first end to the second end to provide a more uniform distribution of particles of coating material within the canister for different orientations of the charging apparatus and canister.

The invention may best be understood by referring to the following description and accompanying drawings which illustrate the invention.

Figure 1:
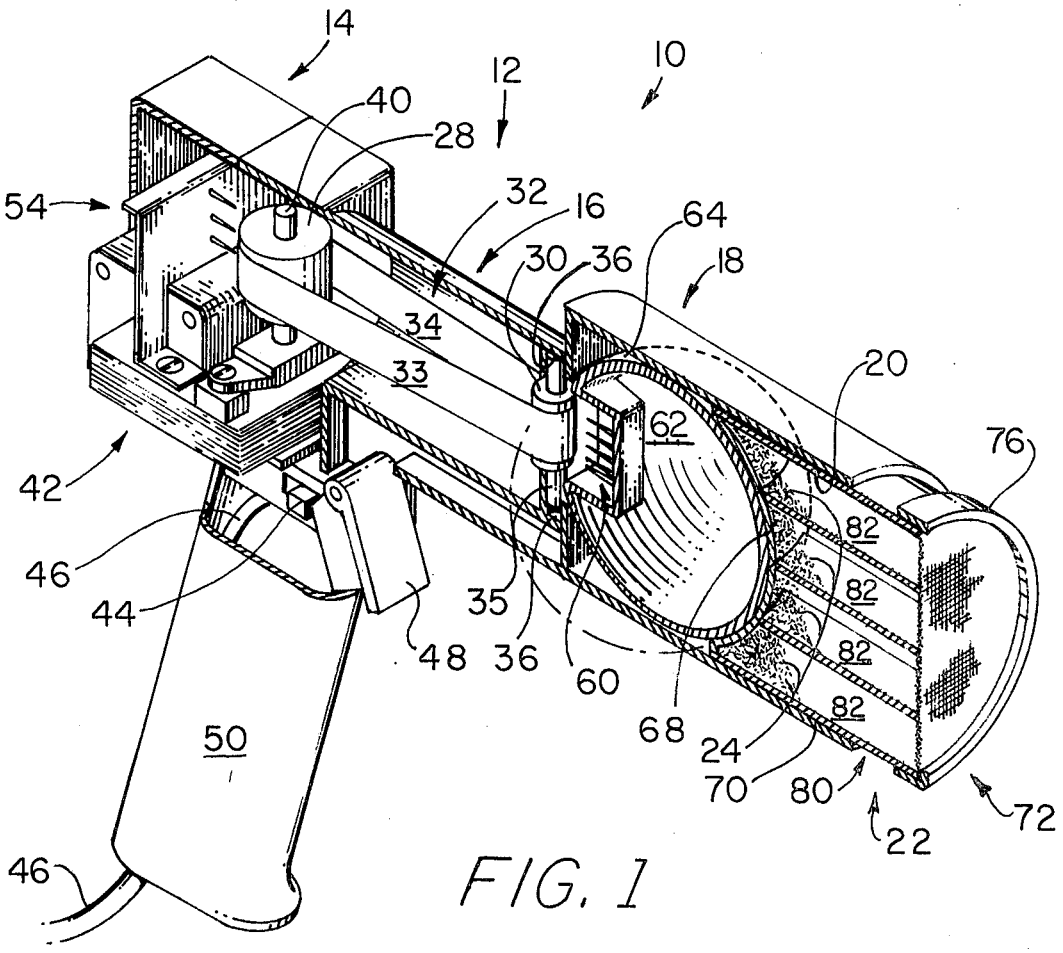
FIG. 1 is a sectional perspective view of an electrostatic hand-held, coating-dispensing apparatus and its coating material container.

In the drawings, a hand-held coating apparatus 10 includes a housing 12 having a proximal end portion 14, an intermediate portion 16 and a distal end portion 18. A socket 20 is formed at the distal end of portion 18 snugly to receive a container or canister 22. Container 22 is provided for retaining particles of coating material 24, e.g., flock fibers, and for transferring electrostatis potential from apparatus 10 to such particles. In the illustrated embodiment housing 12 is constructed of injection molded plastic.

Apparatus 10 further includes a first pulley 28, a second pulley 30, and a belt 32 trained about the pulleys. The runs 33, 34 of belt 32 extend through the intermediate portion 16, which, in the illustrated embodiment, is generally cylindrical in shape. The first and second pulleys 28, 30 are mounted for rotation in the proximal and distal end portions 14, 18 respectively. The second pulley 30 is supported upon a shaft 35 retained in reliefs 36 provided in the walls of housing 12. Pulley 30 is freely rotatable on shaft 35.

First pulley 28 is mounted upon a shaft 40 of a small 110 volt alternating current electric motor 42. Motor 42 is supplied with power through a switch 44 and a power cord 46 from an ordinary household current outlet. Switch 44 is operated by a trigger 48 in the pistol grip handle 50 provided on housing 12. Motor 42 and its associated components are housed in the proximal end portion 14 of housing 12.

Figure 3:
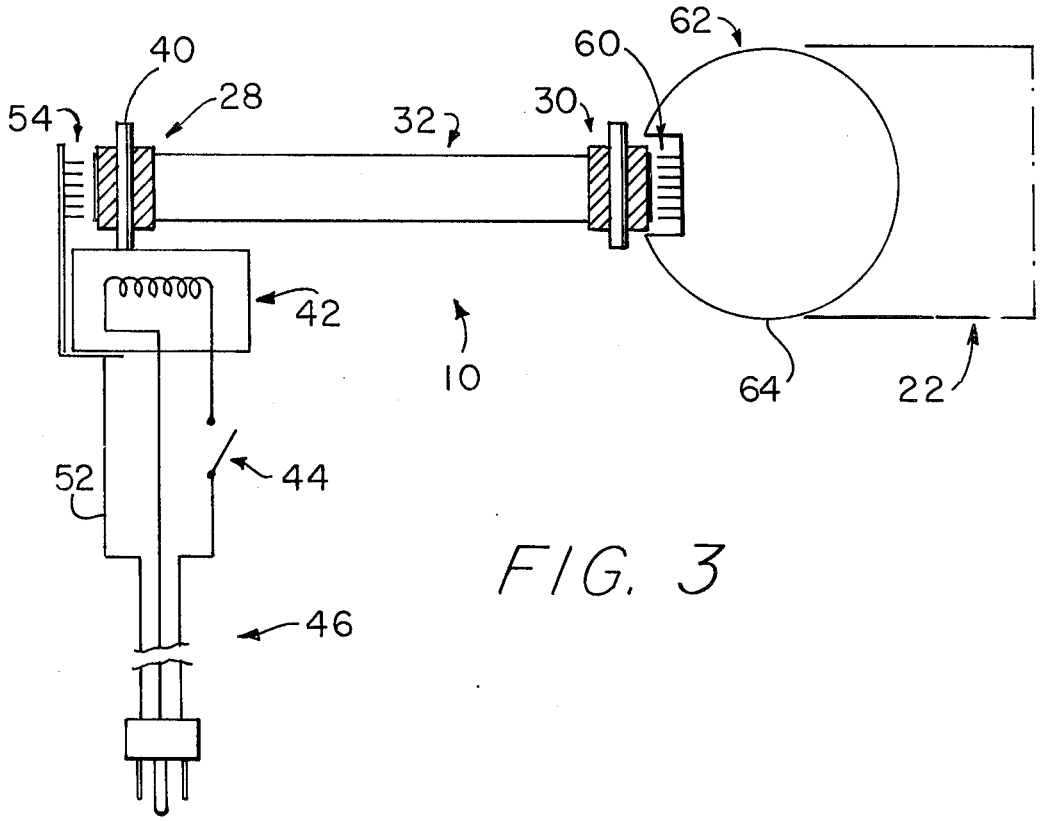
FIG. 3 is a diagrammatic side elevational view of the apparatus of FIGS. 1 and 2, including a wiring diagram.

Power cord 46 in the illustrated embodiment is of a three conductor type and includes a ground lead 52 (FIG. 3). A first conducting brush 54 is supported upon the frame of motor 42. Brush 54 is connected to ground lead 52. The end of brush 54 lies adjacent pulley 28 to conduct to ground any charge carried by belt 32 as the belt moves around pulley 28 past brush 54.

A second conducting brush 60 is adjacent belt 32. Brush 60 is supported upon a spheroid 62 disposed within and supported by the distal end portion 18 of housing 12. Spheroid 62 provides a curved conducting surface 64 to which brush 60 is coupled. Brush 60 lies closely adjacent belt 32 where belt 32 moves about pulley 30. Brush 60 provides a path for movement of charge between conducting surface 64 and belt 32 as belt 32 moves about pulley 30.

In one illustrative embodiment pulley 28 is made of Teflon, pulley 30 is made of nylon, and belt 32 is of a neoprene rubber. Desirably, pulleys 28, 30 should be constructed of materials as far apart as practicable in the triboelectric series. The electrostatic potential to be stored on surface 64 is produced by friction between pulleys 28, 30 and belt 32. Belt 32 serves to carry frictionally produced free negative charges from pulley 30 to ground at brush 54. The deficiency of negative charge on pulley 30 and surface 64 which is coupled thereto by brush 60 results in a positive charge on surface 64.

Spheroid 62 in the illustrated embodiment is a two piece injection molded plastic sphere. Brush 60 is supported therefrom. Spheroid is metal plated to provide exterior conducting surface 64. Brush 60 is connected to this surface.

To transfer the electrostatic potential from surface 64 to particles 24, container 22 includes a first end 68 having a generally spherical curvature substantially equal to the curvature of spheroid 62 to provide intimate contact at several points between surface 64 and end 68. Charge is transferred either through or along the surface or end 68 into the interior thereof where particles of coating material 24 lie against end 68. End 68 is a thin sheet metal plate in the illustrated embodiment; however, it is to be understood that end 68 could be made of a non-conductive material provided with a conductive coating.

Container 22 further includes a cylindrical side wall 70 which is adapted snugly to be received within cylindrical socket 20. Side wall 70 may be constructed of plastic or other suitable material. Very good results have been obtained with a container 22 including a side wall 70 fashioned from a cardboard mailing tube. Such material allows containers 22 to be constructed quite inexpensively. Further, such containers are easily disposed of when their contents are exhausted.

At the distal end of side wall 70 a second end 72 is provided. Second end 72 is provided for passing charged particles of coating material 24 from container 22 toward a target 73 (see FIG. 2) to be coated with coating material 24. In the illustrated embodiment second end 72 is formed from plastic mesh locked in place and held taut by an annular locking ring 76 tightly engaging side wall 70.

Figure 2:
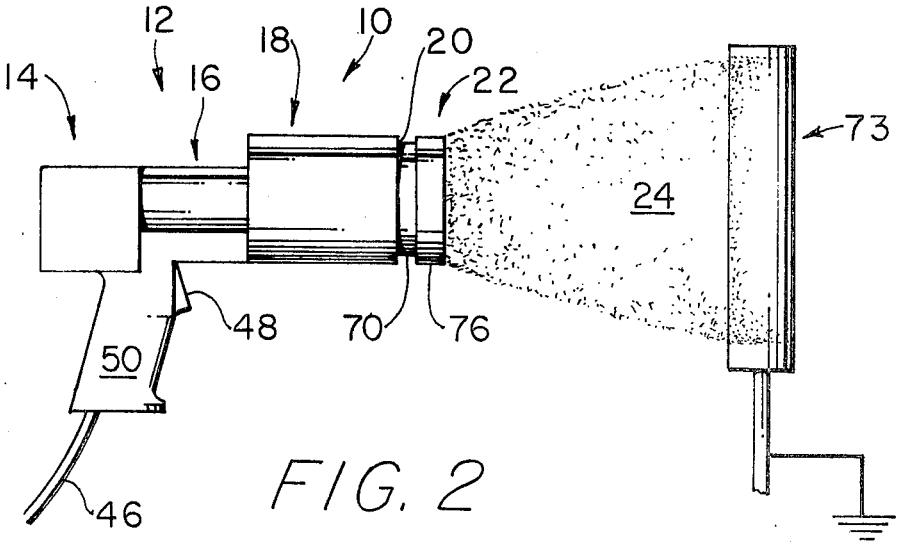
FIG. 2 is a side elevational view of the apparatus of FIG. 1 in use.
Figure 4A:
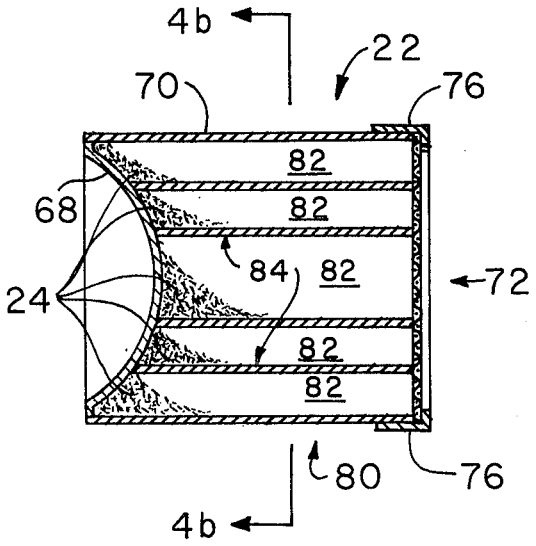
FIGS. 4*a* and 4*b* are sectional side and end elevational views respectively of the coating material container of FIGS. 1–3.
Figure 4B:
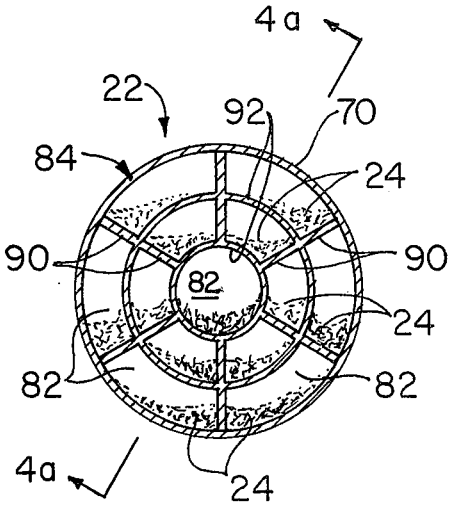

As best illustrated in FIGS. 1 and 4, the interior 80 of container 22 is divided into a plurality of sections 82 extending longitudinally of container 22 substantially the full distance between first and second ends 68, 72. Sections 82 are provided with a number of partitions 84 having axially and radially extending portions 90 and peripherally extending, coaxial portions 92. Sections 82 are provided to separate the coating material 24 in container 22 so that the coating apparatus 10 can be held in a number of different orientations and still produce a substantially uniform distribution of charged particles of coating material 24 between the apparatus 10 and the target 73, as illustrated in FIG. 2. With interior 80 divided into sections 82, each of which is in effect a separate container for coating material 24, the distribution of ejected coating material is substantially improved. An illustrative shape of sections 82 appear in FIG. 4*b*. Rectangular sections, hexagonal (honeycomb) sections or other shapes may also be used.

It is to be understood that the motor 42 could be battery operated. In such a case, the necessary batteries could also be housed in housing 12 so that the apparatus, including the power supply, could be completely self-contained.

The apparatus thus disclosed includes a hand-held Van de Graaff generator and means for transferring the charge from the charged surface of the generator to particles of coating material held adjacent the charged surface.

It is to be understood that the above described invention is not to be limited to the details above given, but that it may be modified within the scope of the appended claims.

What I claim is:

1. An apparatus for electrostatically dispensing dry coating material, said apparatus including means for generating an electrostatic potential, a housing containing said generating means, means carried by said housing for manually actuating said generating means, conductive surface means for storing said electrostatic potential generated by said generator means, the improvement comprising container means separable from said housing for holding said coating material and for transferring said electrostatic potential from said conductive surface means to said coating material, said container means including first and second ends interconnected by a side wall, said container means first end defining a conducting wall means adapted to contact said coating material when held in said container means, means for removably securing said container means to said housing with said conductive surface means adjacent said conducting wall means wherein said electrostatic potential will be transferred from the conductive surface means to the conducting wall means.

2. The apparatus of claim 1 wherein said conductive wall means is juxtaposed with said conductive surface means.

3. The apparatus of claim 2 wherein both said conductive wall and conductive surface means are of a spherical curvature.

4. The apparatus of claim 2 wherein said container means second end defines a mesh wall having openings therein sufficient to pass materials attracted by an exterior potential.

5. The apparatus of claim 4 wherein said container means includes partitions between said container means first and second ends to divide the interior of said container means as defined by said side wall into separate compartment means each extending between said conductive wall means and mesh wall for holding said material.

6. The apparatus of claim 1 wherein said securing means for the container means includes a socket part carried by said housing, said container means fitted frictionally within said socket part.

7. The apparatus of claim 6 wherein said housing includes a pistol grip part and barrel part, said generator means carried within said barrel part and having a discharge end which includes said conductive surface means and which defines said socket part.

8. The apparatus of claim 7 wherein said actuator means for the generator means includes a trigger device located adjacent said grip part.

9. The apparatus of claim 8 wherein said generator means includes an endless belt trained about first and second pulleys in triboelectric contact and extending longitudinally within said housing barrel part, a motor connected to said first pulley for rotating said first pulley and said belt and second pulley thereby, said motor actuated by said trigger device, a grounded brush means located adjacent said first pulley for removing any negative charge upon said belt as it rotates about said pulleys, a second brush means connected to said conductive surface means and located adjacent said second pulley for conducting a positive charge to said conductive surface means.

10. The apparatus of claim 1 wherein said conductive surface means constitutes an end wall of said housing, said conductive wall means being juxtaposed with said conductive surface means.

11. In combination, a container with dry coating material therein for use with an electrostatic dispensing apparatus, said container comprising a conductive wall means and a mesh wall means with a side wall extending therebetween, means for detachably securing said container means to said dispensing apparatus, said conductive wall means positionable next to an electrostatic charge when said container is secured to said dispensing apparatus for conducting said charge to said coating material, said mesh wall means having openings therein large enough to pass said coating material when the material is exposed to an exterior potential.

12. The container of claim 11 and including partition parts extending between said conductive wall means and mesh wall means to divide the interior of said container as defined by its said side wall into separate compartment means each extending between said conductive wall means and mesh wall means for holding said coating material.

13. In a portable hand-held electrostatically-operated applicator for dispensing fibrous material or the like and directing it to a work surface, said applicator including a housing having a forward portion, the improvement comprising socket means formed in said forward portion of the applicator housing, a plurality of containers of said fibrous material, said socket means of the applicator housing being adapted to receive any selected one of said containers wherein the fibrous material therein is directable to said work surface, each of said containers being readily insertable within and alternatively removable from said socket means by manual effort whereby various fibrous materials may be conveniently dispensed from said applicator without requiring the applicator to be cleaned or purged when changing such fibrous materials.

* * * * *